United States Patent [19]

Setsuko et al.

[11] Patent Number: 4,966,660

[45] Date of Patent: Oct. 30, 1990

[54] PROCESS FOR ELECTRODEPOSITION OF ALUMINUM ON METAL SHEET

[75] Inventors: Takahashi Setsuko, Misato; Akimoto Kikuko, Funabashi; Mori Kumiko, Kamagaya; Akama Ryozo, Tokyo, all of Japan

[73] Assignee: Nisshin Steel Co., Ltd., Tokyo, Japan

[21] Appl. No.: 269,142

[22] PCT Filed: Jun. 30, 1988

[86] PCT No.: PCT/JP88/00658

§ 371 Date: Oct. 18, 1988

§ 102(e) Date: Oct. 18, 1988

[87] PCT Pub. No.: WO89/00616

PCT Pub. Date: Jan. 26, 1989

[30] Foreign Application Priority Data

Jul. 13, 1987 [JP] Japan ..... 62-174522
Sep. 29, 1987 [JP] Japan ..... 62-244576

[51] Int. Cl.[5] ..... C25D 5/36; C25D 3/44
[52] U.S. Cl. ..... 204/34; 204/58.5
[58] Field of Search ..... 204/34, 39, 58.5

[56] References Cited

U.S. PATENT DOCUMENTS 2,446,331 8/1948 Hurley ..... 204/39
2,446,349 8/1948 Wier et al. ..... 204/39
2,446,350 8/1948 Wier ..... 204/39
3,136,709 6/1964 Smith ..... 204/28
4,101,386 7/1978 Dotzer ..... 204/58.5
4,747,916 5/1988 Kato et al. ..... 204/58.5

FOREIGN PATENT DOCUMENTS 59-126789 7/1984 Japan .
62-70592 4/1987 Japan .
62-70593 4/1987 Japan .

*Primary Examiner*—T. M. Tufariello
*Attorney, Agent, or Firm*—Foley & Lardner, Schwartz, Jeffery, Schwaab, Mack, Blumenthal & Evans

[57] ABSTRACT

In electroplating aluminum on a metal sheet with use of a molten salt bath comprised of from 40 to 80 mol % of an aluminum halide and from 20 to 60 mol % of an N-alkylpyridinium halide, or a molten salt bath obtained by mixing an organic solvent in said first-mentioned bath, said metal sheet is activated to improve deposit adhesion by carrying out, before plating, electrolysis on said metal sheet, bringing it to serve as an anode and with use of an activating bath having the same composition as said molten salt bath. Also, the bath is purified by leaving metallic aluminum immersed in the bath, or by carrying out preliminary electrolysis under a current density of 0.5 $A/dm^2$ or less with immersion of an anode and a cathode both made of metallic aluminum in the molten salt bath.

6 Claims, No Drawings

PROCESS FOR ELECTRODEPOSITION OF ALUMINUM ON METAL SHEET

TECHNICAL FIELD

This invention relates to a process enabling improvement of the adhesion of electrodeposits and purity of coatings in a process for the electrodeposition of aluminum on a metal sheet by use of a molten salt bath.

BACKGROUND OF THE ART

Electroplating of aluminum can be carried out with difficulty using a plating bath of an aqueous solution type, since aluminum has a large affinity for oxygen and shows a lower potential than hydrogen. For this reason, the electroplating of aluminum has hitherto been carried out using a plating bath of a non-aqueous solution type, in particular, a plating bath of an organic solvent type.

In regard to the plating bath of this organic solvent type, available as a plating bath that secures safety in operations is a molten salt bath comprised of an aluminum halide and an N-alkylpyridinium halide. It includes, for example, a molten salt bath comprised of an aluminum halide and an N-ethylpyridinium halide or a bath obtained by mixing an organic solvent in this bath (U.S. Pat. Nos. 2,446,331; 2,446,349; and 2,446,350). and a molten salt bath comprised of an aluminum halide and an N-butylpyridinium halide, or a bath obtained by mixing an organic solvent, capable of obtaining products having better appearance than those obtained by using the above plating baths even if the plating is carried out in a high current density (Japanese Unexamined Patent Publications No. 70592/1987 and No. 70593/1987, or U.S. Patent application No. 092,517/87).

This molten salt bath, though sometimes bringing about coatings partly having a problem in appearance, comes to a liquid near room temperature and makes it possible to carry out electroplating in the temperature range of approximately from 0° to 150° C. when a compound comprising a halogen atom selected from Cl, Br or I is used as the aluminum halide and a compound whose N-substituted alkyl group has 1 to 5 carbon atoms is used as the N-alkylpyridinium halide in amounts of from 40 to 80 mol % for the aluminum halide and from 20 to 60 mol % for the N-alkylpyridinium halide.

U.S. Pat. No. 2,446,349 discloses that the above molten salt bath dislikes water and oxygen, and presence of these results in oxidation of the bath to lower the quality of plating, thus requiring to bring its atmosphere into a dry and oxygen-free atmosphere. For this reason, also when a metal strip is continuously plated, it is necessary to take care that the water adhered on the strip in the course of a pretreatment of the plating may not be carried in the bath.

Since, however, when oxides exist on the strip, the oxides can not be removed unless an inorganic acid is used, the pretreatment must be carried out using a treatment solution of an aqueous solution type. This pretreatment is commonly carried out through the steps of degreasing, washing with water, pickling using an inorganic acid, washing with water, and, as occasion demands, strike plating, but drying is required before plating to prevent the water from being carried in the bath. This drying, because of an activated state on the surface of the strip, must be carried out in the dry and oxygen-free atmosphere before a good deposit adhesion can be obtained.

A generally available method for giving the dry and oxygen-free atmosphere is a method in which nitrogen gas or argon gas is used. However, this method, though not requiring to use gas in a large quantity in carrying out the plating in an experimental scale since there is less evaporation of water from the strip, requires to use gas in a large quantity in carrying out the continuous plating since there occurs the evaporation of water in a large quantity. Hence, in the case of the continuous plating, a step for carrying out drying in an atmosphere has hitherto been provided between the washing after pickling and the plating in a bath. This method, however, have had the problem that because of the activated state on the surface of the strip an oxide coating is formed thereon even if the drying is carried out in a short time, resulting in a lowering of the deposit adhesion.

Also, in recent years, high-purity aluminized metal sheets have attracted notices as electronic parts such as IC lead frames and materials for magnetic discs, but plating on such products requires high purity of the bath. However, the aluminum halide to be used contains a trance amount of impurities such as Fe, Pb and $H_2O$ even if it is of high purity, and hence has been inevitably accompanied with inclusion of impurities. It has hence been difficult to attain a 99.9% or more Al purity of coatings, and moreover, the impurities may give a greater influence if the plating is carried out at a bath temperature of 40° C. or more, resulting in no denseness of the coatings.

This have caused the problems that employment thereof in the IC lead frames may result in a poor bonding property to aluminum wires and working thereof into the magnetic discs may result in no capability of precise bore working by anodizing treatment.

A first object of this invention is to provide a process for the electrodeposition of aluminum, that can activate the surface by an inexpensive means even if the drying is carried out in an atmosphere after the pretreatment with use of a treatment solution of the aqueous solution type, when aluminum is continuously plated on the metal strip.

A second object of this invention is to provide a process for the electrodeposition of aluminum, that enables aluminum plating with a 99.9% or more purity.

A third object of this invention is to further provide a process for the electrodeposition of aluminum, that enables aluminum plating with a 99.9% or more purity and with denseness, even when the plating is carried out at a bath temperature of 40° C. or more.

DISCLOSURE OF THE INVENTION

This invention provides a process for the electrodeposition of aluminum, comprising electroplating aluminum on a metal sheet with use of a molten salt bath comprised of from 40 to 80 mol % of an aluminum halide represented by the formula $AlX_3$, wherein X is Cl, Br or I, and from 20 to 60 mol % of an N-alkylpyridinium halide represented by the formula $C_5H_5N$-RX, wherein R is an alkyl group having 1 to 5 carbon atoms and X is a halogen atom, or a molten salt bath obtained by mixing an organic solvent in said first-mentioned bath, wherein, before plating, said metal sheet is activated by carrying out electrolysis on said metal sheet, bringing it to serve as an anode and with use of an activating bath having the same composition as said molten salt bath. Also, the molten salt bath is purified by leaving metallic aluminum immersed in the bath before plating, or by carrying out preliminary electrolysis under a current density of 0.5 A/dm$^2$ or less with immersion of an anode and a cathode both made of metallic aluminum.

The above molten salt bath is so large in the corrosive power that the materials that can resist it are almost limited to fluorine resins and composite materials with the resins, and has a corrosive power to dissolve almost all metals. Hence, carrying out electrolysis by bringing a metal sheet to serve as an anode and with use of an activating bath having the same composition as the molten salt bath enables ready removal of such a thin oxide coating that has been formed as a result of the drying in an atmosphere after pickling, thus bringing about activation of the surface.

Also, immersing of metallic aluminum in the molten salt bath enables substitution of impurities Fe, Pb, etc. with Al owing to potential difference, which impurities are deposited on the surface of the metallic aluminum and removed. This substitution deposition can be further promoted when the electrolysis is carried out by using metallic aluminum for both electrodes.

BEST MODE FOR WORKING THE INVENTION

The activating bath may preferably be comprised of from 50 to 75 mol % of the aluminum halide and from 25 to 50 mol % of the N-alkylpyridinium halide. The aluminum halide concentration otherwise lower than 50 mol % results in a high concentration of N-alkylpyridinium cations to readily cause reduction of the cations at the anode, thus bringing about loss of the balance of the bath composition and also easy adhesion of organic matters on the anode. On the other hand, the aluminum halide otherwise more than 75 mol % may result in a lowering of the electrical conductivity of the bath.

Adding from 25 to 75 mol % of an organic solvent to the activating bath enables increase in the electrical conductivity and makes it possible to achieve activation at a high speed. This organic solvent may preferably include solvents of aromatic group types.

The activating bath is disposed in the same chamber as the molten salt bath for use in plating, and kept in the dry and oxygen-free atmosphere so that the strip may not be oxidized while it is transferred from the activating bath into the molten salt bath. The electrolysis, when it comprises the bath to which no organic solvent is added, may be carried out under $1 \times 10^{-3}$ to 1 A/dm$^2$ using a direct current or a pulse current, so that the bath can be activated with good efficiency. The bath temperature may preferably be set to 0° to 150° C. The temperature lower than 0° C. makes it difficult to achieve uniform activation because of a high viscosity, and the temperature made higher than 150° C. tends to cause side reaction or adhesion of organic matters in the case of a high current density, resulting in difficulty in the activation of the metal sheet surface.

Carrying out the electrolysis under the above current density can bring about the activation with high efficiency also when the organic solvent has been added in the molten salt bath. However, a bath temperature made lower than 10° C. may sometimes cause coagulation, and a bath temperature made higher than 80° C. may result in excessive evaporation of the solvent. Accordingly, the temperature may preferably be set to 10° to 80° C.

The electrolysis is carried out for the time ranging from 5 seconds to 1 hour. The time otherwise shorter than 5 seconds may bring about poorness of deposit adhesion because of insufficient achievement of the activation, resulting in easy peeling when a coating is peeled by applying thereon an adhesive tape. The activation, however, can be promised if the electrolysis is carried out for 1 hour even by electrolysis under a low current density.

In carrying out the electrolysis, the anode comprised of Al enables the impurities having been eluted from the metal sheet into the bath, to be deposited on the anode owing to the potential difference without their accumulation in the bath, thus making it possible to keep always clean the activating bath.

After the activation, there is no problem if the solution in the activating bath is carried in the molten salt bath, because the activating bath and the molten salt bath for use in plating are constituted of the same components, so that the strip can be transferred into the molten salt bath only by simply removing the activating solution. If the bath composition of the molten salt bath is desired not to be changed, both the baths may be made to have the same composition.

The metallic aluminum used for purifying the molten salt bath may preferably take the form of something that can be readily immersed in and lifted out of the plating bath, as exemplified by a wire.

In the instance where the purification is carried out by immersing, the metallic aluminum may be immersed for 5 hours or more while controlling the bath temperature at from 20° to 150° C. The bath temperature otherwise less than 20° C. makes the substitution-deposition reaction to take place with difficulty to require much time for the purification, and the temperature otherwise more than 150° C. may bring about decomposition of the N-alkylpyridinium halide.

In the instance where the purification is carried out by electrolysis, it can be carried out by effecting electrolysis for 1 hour or more in usual cases and under a current density of 0.5 A/dm$^2$ or less. The current density otherwise made more than 0.5 A/dm$^2$ may result in predominant deposition of Al, may result in a greater proportion of the deposition of Al with respect to the deposition of impurities, and also may result in a large waste of Al.

In this electrolysis, the anode is made to comprise metallic aluminum for the purpose of preventing a variation of bath composition that may be caused if the anode is constituted of an insoluble pole, when Al in the bath is deposited during the preliminary electrolysis under the above current density. The anode constituted of metallic aluminum enables Al to be dissolved and fed from the anode in proportion to the amount of applied electric currents, so that the plating bath composition can be kept in the state of initial make-up of an electrolytic bath.

Purifying the molten salt bath according to such procedures, which contains 0.01 to 0.1% of Fe, 0.005 to 0.03% of Pb and 0.01 to 0.1% of $H_2O$ at the time of the initial make-up of an electrolytic bath, can bring the Fe content to 0.003% or less, the Pb content to no detection, and the $H_2O$ content to 0.005% or less after the purification, and carrying out aluminum plating with use of this bath can bring about a coating having a high purity of 99.9% or more.

Carrying out the purification in the manner as described above makes the coating dense and yet not to have any powdery dendrite texture, even when the plating on the metal sheet is carried out at bath temperatures of from 0° to 150° C. and also under current current densities of from 0.1 to 30 A/dm$^2$. The bath temperature otherwise made lower than 0° C. may result in difficulty in carrying out the plating under a high current density. Also, the bath temperature otherwise made higher than 150° C. and the current density made higher than 30 A/dm$^2$ makes the coating grayish, resulting in poor appearance and also a lowering of workability on the coating.

The plating is carried out in the dry and oxygenfree atmosphere as conventionally done (for example, in dry $N_2$ or Ar) for the purpose of preventing oxidation of the bath. As for the electric current, any of direct current and pulse current may be used, but the pulse current can make crystals finer and can make workability better.

To perform uniform plating in the continuous plating, it is necessary to supply Al ions to the molten salt bath to control the Al ions in the bath to a constant amount. In this occasion, however, the anode may be constituted of a soluble anode made of Al, thereby enabling automatical supply of Al ions in accordance with the amount of electric current, advantageously.

To supply Al ions when the continuous plating is carried out by using as the anode an insoluble anode of TiPt type or the like, halides such as $AlCl_3$, $AlBr_3$ and $AlI_3$ may be supplied. In this occasion, the halides to be supplied requires purification, which purification may be carried out by providing a halide-supply tank outside a plating tank for the molten salt bath, and providing a purification tank between this supply tank and the plating tank, thus being carried out in this purification tank according to the method previously described. However, when the continuous plating is performed by using the insoluble anode, reaction takes place to generate halogen gas at the anode interface during the electrolysis.

EXAMPLE 1

A cold rolled sheet, a SUS430 sheet and a SUS316 sheet, all having a sheet thickness of 0.1 mm were subjected to pretreatments for electrolytic degreasing by use of a treatment solution of an aqueous solution type, washing with water, pickling by inorganic acid, and washing with water, followed by drying in an atmosphere, and then immersed in an activating bath of an aluminum chloride/N-butylpyridinium chloride (PBC) type (mixing molar ratio: 2:1) in an $N_2$ atmosphere to carry out electrolysis in an Al plate serving as the anode and using a direct current.

Thereafter, the steel sheets were each transferred in a molten salt bath having the same composition as the above activating bath, and an Al plate (purity: 99.99%; sheet thickness: 5 mm) was used as the anode, thus applying electroplating of aluminum for 15 minutes using a direct current under a current density of 1 A/dm$^2$. Table 1 shows the relationship between the activating conditions and the deposit adhesion.

TABLE 1

| | | Conditions for electrolysis activation treatment | | | | | |
|---|---|---|---|---|---|---|---|
| | | Bath composition | | | Current | | Deposit adhesion |
| No. | Metal sheet | $AlCl_3$ | BPC | Organic solvent | density (A/dm$^2$) | Time | |
| Examples: | | | | | | | |
| 1 | CRS* | 60 | 40 | — | 0.1 | 3 min | Good |
| 2 | " | " | " | — | 0.05 | 10 min | " |
| 3 | " | 67 | 33 | — | 0.5 | 30 sec | " |
| 4 | " | " | " | — | 0.01 | 50 min | " |
| 5 | " | " | " | Benzene | 0.1 | 3 min | " |
| 6 | SUS430 | 55 | 45 | — | 1.0 | 15 sec | " |
| 7 | " | " | " | — | 0.1 | 3 min | " |
| 8 | " | 62 | 38 | — | 0.5 | 30 sec | " |
| 9 | " | " | " | — | 0.05 | 10 min | " |
| 10 | " | " | " | Toluene | 0.1 | 3 min | " |
| 11 | SUS316 | 57 | 43 | — | 0.5 | 30 sec | " |
| 12 | " | " | " | — | 0.05 | 10 min | " |
| 13 | " | 65 | 35 | — | 0.1 | 3 min | " |
| 14 | " | " | " | — | 0.01 | 50 min | " |
| 15 | " | " | " | Ben/Tol | 0.1 | 3 min | " |
| Compatative Examples: | | | | | | | |
| 1 | CRS* | — | — | — | — | — | Peeled |
| 2 | SUS430 | — | — | — | — | — | " |
| 3 | SUS316 | — | — | — | — | — | " |

*Cold rolled sheet

Notes:

In the bath composition, $AlCl_3$ and BPC were added in terms of mol %; and the organic solvents, in an amount of 50 vol % based on the total of $AlCl_3$ and BPC. Ben/Tol indicates a mixed solvent of benzene with toluene in equal amount.

EXAMPLE 2

Example 1 was repeated to carry out the activation treatment and the electroplating but using an activating bath and a molten salt bath in which aluminum bromide or alkylpyridinium iodide was used as the aluminum halide ($AlX_3$) and N-alkylpyridinium bromide or N-alkylpyridinium iodide was used as the N-alkylpyridinium halide (RPX). In each bath, $AlX_3$ and PRX were mixed in molar ratio of 2:1. Table 2 shows the relationship between the activating conditions and the deposit adhesion.

TABLE 2

| No. | Metal sheet | Conditions for electrolysis activation treatment: Bath composition: $AlX_3$ | RPX | Organic solvent | Current density ($A/dm^2$) | Time | Deposit adhesion |
|---|---|---|---|---|---|---|---|
| Examples: | | | | | | | |
| 1 | CRS* | $AlBr_3$ (60) | BPBr (40) | — | 0.1 | 3 min | Good |
| 2 | " | $AlBr_3$ (67) | BPBr (33) | — | 0.05 | 10 min | " |
| 3 | " | $AlI_3$ (60) | EPI (40) | — | 0.5 | 30 sec | " |
| 4 | " | $AlI_3$ (67) | EPI (33) | — | 0.01 | 50 min | " |
| 5 | " | $AlBr_3$ (60) | MPBr (40) | Benzene | 0.1 | 3 min | " |
| 6 | SUS430 | $AlBr_3$ (55) | BPBr (45) | — | 1.0 | 15 sec | " |
| 7 | " | $AlBr_3$ (62) | EPBr (38) | — | 0.5 | 30 sec | " |
| 8 | " | $AlI_3$ (55) | BPI (45) | — | 0.05 | 10 min | " |
| 9 | " | $AlI_3$ (62) | EPI (38) | — | 0.1 | 3 min | " |
| 10 | " | $AlBr_3$ (65) | BPBr (35) | Toluene | 0.1 | 3 min | " |
| 11 | SUS316 | $AlBr_3$ (57) | BPBr (43) | — | 0.5 | 30 sec | " |
| 12 | " | $AlBr_3$ (65) | MPBr (35) | — | 0.05 | 10 min | " |
| 13 | " | $AlI_3$ (57) | BPI (43) | — | 0.1 | 3 min. | " |
| 14 | " | $AlI_3$ (65) | EPI (35) | — | 0.01 | 50 min | " |
| 15 | " | $AlBr_3$ (62) | EPBr (38) | Ben/Tol | 0.1 | 3 min | " |

*Cold rolled sheet

Notes:

In the bath composition, $AlX_3$ and RPX were added in terms of mol %; and the organic solvents, in an amount of 50 vol % based on the total of $AlX_3$ and RPX. Ben/Tol indicates a mixed solvent of benzene with toluene in equal amount. In RPX, MPBr is methylpyridinium bromide; EPBr, ethylpyridinium bromide; BPBr, butylpyridinium bromide; EPI, ethyl-pyridinium iodide; and BPI, butylpyridinium iodide.

EXAMPLE 3

In a molten salt bath comprised of 60 mol % of $AlCl_3$ and 40 mol % of N-butylpyridinium chloride and kept in an $N_2$ atmosphere, an Al wire (purity: 99.99% or more) was immersed and left for 10 hours at 100° C. to effect purification of the bath Next, the temperature of this plating bath was lowered to 40° C., and a cold rolled sheet (sheet thickness: 0.5 mm) having been pretreated as in No. 1 in Table 1 of Example 1 was immersed to carry out the electroplating of aluminum under the same electrolysis conditions as in Example 1.

A coating on the resulting aluminized sheet had a purity of 99.97%, showed a uniform thickness, assumed a white color, and comprised dense crystals. Also, no cracking or peeling occurred even when bending was repeatedly applied on the steel sheet, showing both good workability and adhesion.

EXAMPLE 4

Aluminum plates were used to constitute the both electrodes in a molten salt bath comprised of 67 mol % of $AlCl_3$ and 33 mol % of N-butylpyridinium chloride and kept in an $N_2$ atmosphere, and preliminary electrolysis was carried out for 3 hours under 0.1 $A/dm^2$ to effect purification. Thereafter, using this bath, the electroplating of aluminum was carried out on a cold rolled sheet having been pretreated as in No. 1 in Table 1 of Example 1, bringing an aluminum plate (the same as in Example 1) to serve as the anode, for 2 minutes at a bath temperature of 60° C., using a direct current under a current density of 10 $A/dm^2$.

A coating on the resulting aluminized sheet had a purity of 99.99%, and showed the same appearance, crystal state and workability as in the case of Example 2.

EXAMPLE 5

A molten salt bath comprised of 60 mol % of $AlBr_3$ and 40 mol % of N-butylpyridinium bromide and kept in an $N_2$ atmosphere was purified in the same Al wire immersing method as in Example 2, except that the bath was kept to a temperature of 60° C. and left for immersion for 20 hours.

Subsequently, the temperature of this plating bath was raised to 80° C., and the electroplating of aluminum was carried out on a cold rolled sheet having been activated for an electrolysis time of 30 seconds under a current density of 0.5 $A/dm^2$ with use of an activating bath comprised of 60 mol % of $AlBr_3$ and 40 mol % of N-butylpyridinium bromide, bringing an aluminum plate (the same as in Example 1) to serve as the anode, for 1 minute using a direct current under a current density of 20 $A/dm^2$.

A coating on the resulting aluminized sheet had a purity of 99.99%, showed good appearance, crystal state and workability.

EXAMPLE 6

In Examples 2 to 4, plating was carried out by replacing the electric current with a pulse current at the time of the electroplating of aluminum. In each instance, the plating was carried out using the pulse current having a duty ratio of from 1/10 to 1/100 and an average current density of from 0.1 to 30 A/dm$^2$. As a result, coatings showed the same properties as in the case when the plating was carried out using the direct current, and the coatings all had a purity of 99.98% or more.

COMPARATIVE EXAMPLE

Using an unpurified molten salt bath comprised of 67 mol % of $AlCl_3$ and 33 mol % of N-butylpyridinium chloride and kept in an $N_2$ atmosphere, aluminum plating was carried out under the same electrolysis conditions as in Example 3 on the cold rolled sheet having been pretreated as No. 1 in Table 1 of Example 1. The resulting plated sheet had a grayish appearance, and comprised coarse crystals. A coating thereof had a purity of 99.0%.

POSSIBILITY OF INDUSTRIAL UTILIZATION

The aluminized metal sheet obtained by this invention has a superior adhesion and also has a high purity of coatings, and hence can be utilized in the manufacture of IC lead frames and magnetic discs.

We claim:

1. A process for the electrodeposition of aluminum on a metal sheet, comprising electroplating aluminum with use of a molten salt bath comprised of from 40 to 80 mol % of an aluminum halide represented by the formula $AlX_3$, wherein X is Cl, Br or I, and from 20 to 60 mol % of an N-alkylpyridinium halide represented by the formula $C_5H_5N$—RX, wherein R is an alkyl group having 1 to 5 carbon atoms and X is a halogen atom, wherein, before plating, said metal sheet is activated by carrying out electrolysis on said metal sheet, bringing it to serve as an anode and with use of an activating bath having the same composition as said molten salt bath, and the molten salt bath is purified by leaving metallic aluminum immersed in the bath.

2. The process for the electrodeposition of aluminum on a metal sheet according to claim 1, wherein the cathode comprises aluminum.

3. The process for the electrodeposition of aluminum on a metal sheet according to claim 1, wherein the electrolysis is carried out under a current density of from $1\times10^{-3}$ to 1 A/dm$^2$.

4. The process for the electrodeposition of aluminum on a metal sheet according to claim 1, wherein said molten salt bath further comprises an organic solvent.

5. A process for the electrodeposition of aluminum on a metal sheet, comprising electroplating aluminum with use of a molten salt bath comprised of from 40 to 80 mol % of an aluminum halide represented by the formula $AlX_3$, wherein X is Cl, Br or I, and from 20 to 60 mol % of an N-alkylpyridinium halide represented by the formula $C_5H_5N$—RX, wherein R is an alkyl group having 1 to 5 carbon atoms and X is a halogen atom, wherein, before plating, said metal sheet is activated by carrying out electrolysis on said metal sheet, bringing it to serve as an anode and with use of an activating bath having the same composition as said molten salt bath, and preliminary electrolysis is carried out under a current density of 0.5 A/dm$^2$ or less with immersion of an anode and a cathode both mode of metallic aluminum in the molten salt bath.

6. The process for the electrodeposition of aluminum on a metal sheet according to claim 5, wherein said molten salt bath further comprises an organic solvent.

* * * * *

UNITED STATES PATENT AND TRADEMARK OFFICE

CERTIFICATE OF CORRECTION

PATENT NO. : 4,966,660

DATED : Oct. 30, 1990

INVENTOR(S) : TAKAHASHI et al

It is certified that error appears in the above—identified patent and that said Letters Patent is hereby corrected as shown below:

Title page:

Item (75) inventors:

"Takahashi Setsuko" should read --Setsuko TAKAHASHI--;

"Akimoto Kikuko" should read --Kikuko AKIMOTO--;

"Mori Kumiko" should read --Kumiko MORI--; and

"Akama Ryozo" should read --Ryozo AKAMA--.

Signed and Sealed this

Ninth Day of February, 1993

*Attest:*

STEPHEN G. KUNIN

*Attesting Officer*

*Acting Commissioner of Patents and Trademarks*